US008177522B2

(12) United States Patent
Kiem et al.

(10) Patent No.: US 8,177,522 B2
(45) Date of Patent: May 15, 2012

(54) MODE CHANGING APPARATUS FOR A SCROLL COMPRESSOR

(75) Inventors: Myung-Kyun Kiem, Seoul (KR); Seon-Woong Hwang, Seoul (KR)

(73) Assignee: LG Electronics Inc., Seoul (KR)

( * ) Notice: Subject to any disclaimer, the term of this patent is extended or adjusted under 35 U.S.C. 154(b) by 595 days.

(21) Appl. No.: 12/361,451

(22) Filed: Jan. 28, 2009

(65) Prior Publication Data

US 2009/0196781 A1 Aug. 6, 2009

(30) Foreign Application Priority Data

Jan. 31, 2008 (KR) ..... 10-2008-0010376

(51) Int. Cl.
*F04B 49/02* (2006.01)

(52) U.S. Cl. ..... 417/307; 417/270; 417/410.5; 417/213

(58) Field of Classification Search ..... 417/440, 417/330, 411, 279, 307, 270, 374, 321, 310, 417/295, 222.2, 242, 410.5, 213; 418/55, 418/55.5, 57, 180
See application file for complete search history.

(56) References Cited

U.S. PATENT DOCUMENTS

| | | | | |
|---|---|---|---|---|
| 4,744,733 | A | 5/1988 | Terauchi et al. | |
| 4,846,633 | A | 7/1989 | Suzuki et al. | |
| 5,639,225 | A | 6/1997 | Matsuda et al. | |
| 2004/0197204 | A1 | 10/2004 | Yamanouchi et al. | |
| 2007/0053782 | A1 * | 3/2007 | Okamoto et al. | 418/30 |
| 2009/0277216 | A1 * | 11/2009 | Shimizu et al. | 62/498 |

FOREIGN PATENT DOCUMENTS

| | | | |
|---|---|---|---|
| GB | 2 403 271 | A | 12/2004 |
| JP | 61-87988 | A | 5/1986 |
| JP | 63-134894 | | 6/1988 |
| JP | 01-106990 | | 4/1989 |
| JP | 8-303361 | | 11/1996 |
| JP | 2003-74481 | A | 3/2003 |
| JP | 2007-132257 | | 5/2007 |
| JP | 2007-285147 | | 11/2007 |
| KR | 10-2005-0012633 | | 2/2005 |
| KR | 10-2005-0095246 | | 9/2005 |

OTHER PUBLICATIONS

Korean Office Action dated Jun. 29, 2009.
European Search Report dated Mar. 25, 2011. (Application No. 09151717.7-2315/2085617).

* cited by examiner

*Primary Examiner* — Joseph L Williams
*Assistant Examiner* — Fatima Farokhrooz
(74) *Attorney, Agent, or Firm* — Ked & Associates LLP

(57) ABSTRACT

A mode changing apparatus for a scroll compressor is provided that may include a low-pressure passage that communicates with a suction side formed by an orbiting motion of an orbiting scroll, an intermediate-pressure passage that communicates with an intermediate-pressure side formed by the orbiting motion of the orbiting scroll, a block assembly mounted at the fixed scroll and having a connection channel that connects the low-pressure passage and the intermediate-pressure passage, a switching device disposed at the block assembly that opens/closes the connection channel, and a pressure supply device that selectively applies, to the block assembly, a discharge gas pressure discharged from the fixed and orbiting scrolls and a suction gas pressure sucked into the fixed and orbiting scrolls, to thereby operate the switching device. With such a simplified structure, the gas compression capacity of a scroll compressor may be varied, enhancing energy efficiency of a system.

20 Claims, 9 Drawing Sheets

MODE CHANGING APPARATUS FOR A SCROLL COMPRESSOR

The present application claims priority to Korean Application No. 10-2008-0010376, filed in Korea on Jan. 31, 2008, which is herein expressly incorporated by reference in its entirety.

BACKGROUND

1. Field

A scroll compressor, and more particularly, a mode changing apparatus for a scroll compressor are disclosed herein.

2. Background

Scroll compressors are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
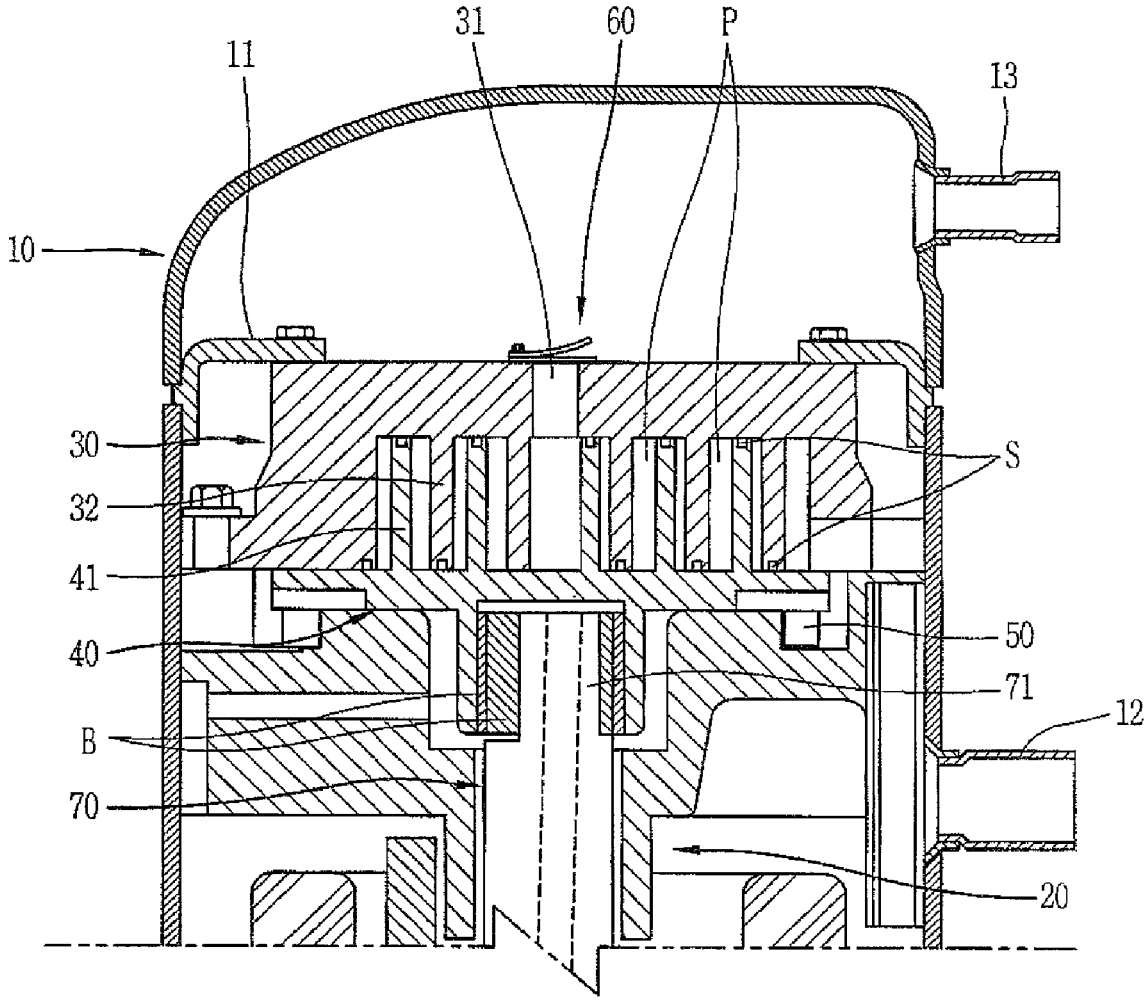
FIG. 1 is a cross-sectional view of a compression part of a scroll compressor according to an embodiment.

Description will now be given in detail of a mode changing apparatus for a scroll compressor according to embodiments, with reference to the accompanying drawings. Where possible, like reference numerals have been used to indicate like elements.

In general, a compressor converts electrical energy into kinetic energy to compress a refrigerant gas. A compressor may be a component in a refrigerating cycle system, and may be categorized into various types, such as a rotary compressor, a scroll compressor, or a reciprocating compressor, according to a compression mechanism of a compression part that compresses the refrigerant. Compressors have been widely used, for example, in a refrigerator, an air conditioner, a showcase, and similar devices.

Figure 2:
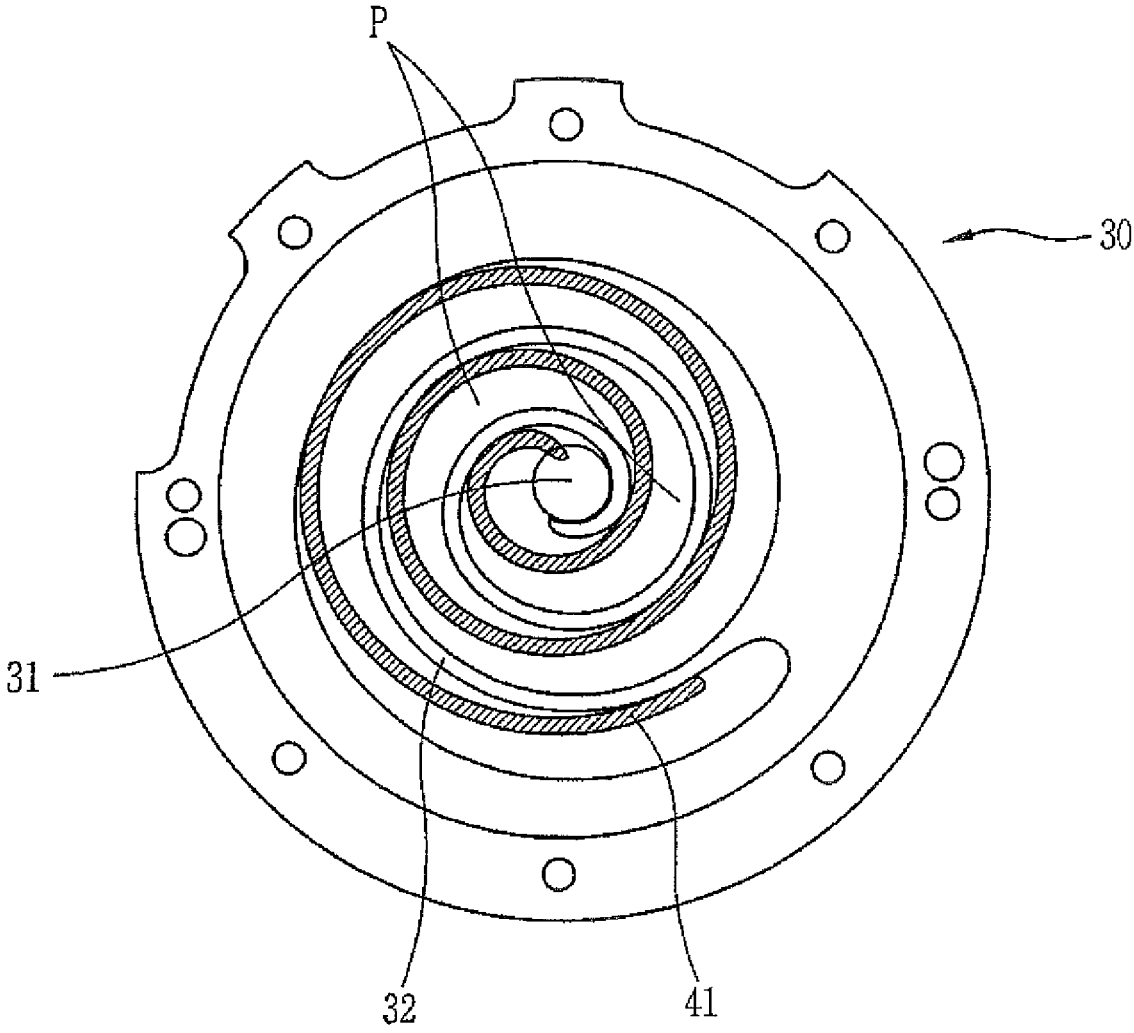
FIG. 2 is a plane view of a fixed scroll wrap and an orbiting scroll wrap of the compression part of the scroll compressor of FIG. 1.

FIG. 1 is a cross-sectional view of a compression part of a scroll compressor according to an embodiment, and FIG. 2 is a plane view of a fixed scroll and an orbiting scroll of the compression part of the scroll compressor of FIG. 1. As shown in FIGS. 1-2, the compression part of the scroll compressor may include a fixed scroll 30 disposed adjacent an upper frame 20 mounted inside a casing 10 with a certain gap therebetween and fixedly coupled to an inside of the casing 10, an orbiting scroll 40 disposed between the fixed scroll 30 and the upper frame 20 that performs an orbiting motion while interlocked with the fixed scroll 30, an Oldham ring 50 inserted between the orbiting scroll 40 and the upper frame 20 that prevents the orbiting scroll 40 from rotating on its axis, a high/low pressure separator 11 coupled to the fixed scroll 30 and the casing 10 that divides the inside of the casing 10 into a high pressure space and a low pressure space, and a discharge valve assembly 60 mounted on an upper surface of the fixed scroll 30 that opens/closes a discharge hole 31 formed in the fixed scroll 30.

The orbiting scroll 40 may be connected to an eccentric portion 71 of a rotation shaft 70 inserted into the upper frame 20. A suction pipe 12 through which gas may be sucked may be coupled to one side of the casing 10 at the lower pressure space, and a discharge pipe 13 through which a gas may be discharged may be coupled to one side of the casing 10 at the high pressure space. Reference numerals 32 and 41 denote a wrap of the fixed scroll 30 and a wrap of the orbiting scroll 40, respectively, each protruding in an involute shape, B denotes bushes, and S denotes a sealing member.

Operation of the compression part of the above-described scroll compressor will be described in detail herein below.

First, as a rotation force of a motor part is transferred, the rotation shaft 70 may be rotated. Then, the orbiting scroll 60 may perform an orbiting motion based on the rotation of the rotation shaft 70, while interlocked with the eccentric portion 71 and constrained by the Oldham ring 50 so as not to rotate on its axis.

As the orbiting scroll 40 performs the orbiting motion, the wrap 41 of the orbiting scroll 40 may perform the orbiting motion while interlocked with the wrap 32 of the fixed scroll 30. A plurality of compression pockets P may be formed between the wrap 41 of the orbiting scroll 40 and the wrap 32 of the fixed scroll 30. As the compression pockets P move toward centers of the fixed and orbiting scrolls 30 and 40, the compression pockets P may change (i.e., decrease) in volume. Accordingly, a gas may be sucked, compressed, and discharged through the discharge hole 31 in the fixed scroll 30. The high-temperature/high-pressure gas discharged through the discharge hole 31 in the fixed scroll 30 may be discharged to outside of the casing 10 through the discharge pipe 13 via the high pressure space.

In general, scroll compressors may be divided into high pressure scroll compressors and low pressure scroll compressors according to a pressure state inside the casing 10, and may also be divided into symmetrical scroll compressors and asymmetrical scroll compressors according to a pressure state inside the plurality of compression pockets. Two compression pockets move toward the centers of the scrolls while gas is respectively sucked into the compression pockets. If the volume of the gas in the two compression pockets is the same, it is called a 'symmetric' scroll compressor, and if the volume of the gas therein is different, it is called an 'asymmetric' scroll compressor.

Such a scroll compressor is generally a component of a refrigerating cycle system, and a refrigerating cycle system having a scroll compressor may be mounted in an air conditioner. In order to minimize power consumption in an air conditioner, a capacity of the scroll compressor may be varied during operation of the refrigerating cycle system of the air conditioner. That is, the scroll compressor may be operated in a power mode if a flow amount of a discharge gas is to be increased under a large load. On the contrary, if a flow amount of a discharge gas is to be decreased under a small load, the scroll compressor may be operated in a saving mode.

An inverter scheme and a by-pass scheme may be provided to vary a capacity of the scroll compressor. The inverter scheme varies a rotation speed of a motor of a motor part; however, it requires a complicated control operation and an expensive unit cost for components. The by-pass scheme uses a constant-speed motor to enable communication between a high pressure side and a low pressure side. The unit cost of the by-pass scheme is relatively inexpensive; however, the manufacturing process is complicated and a size of the compressor is larger.

Figure 3:
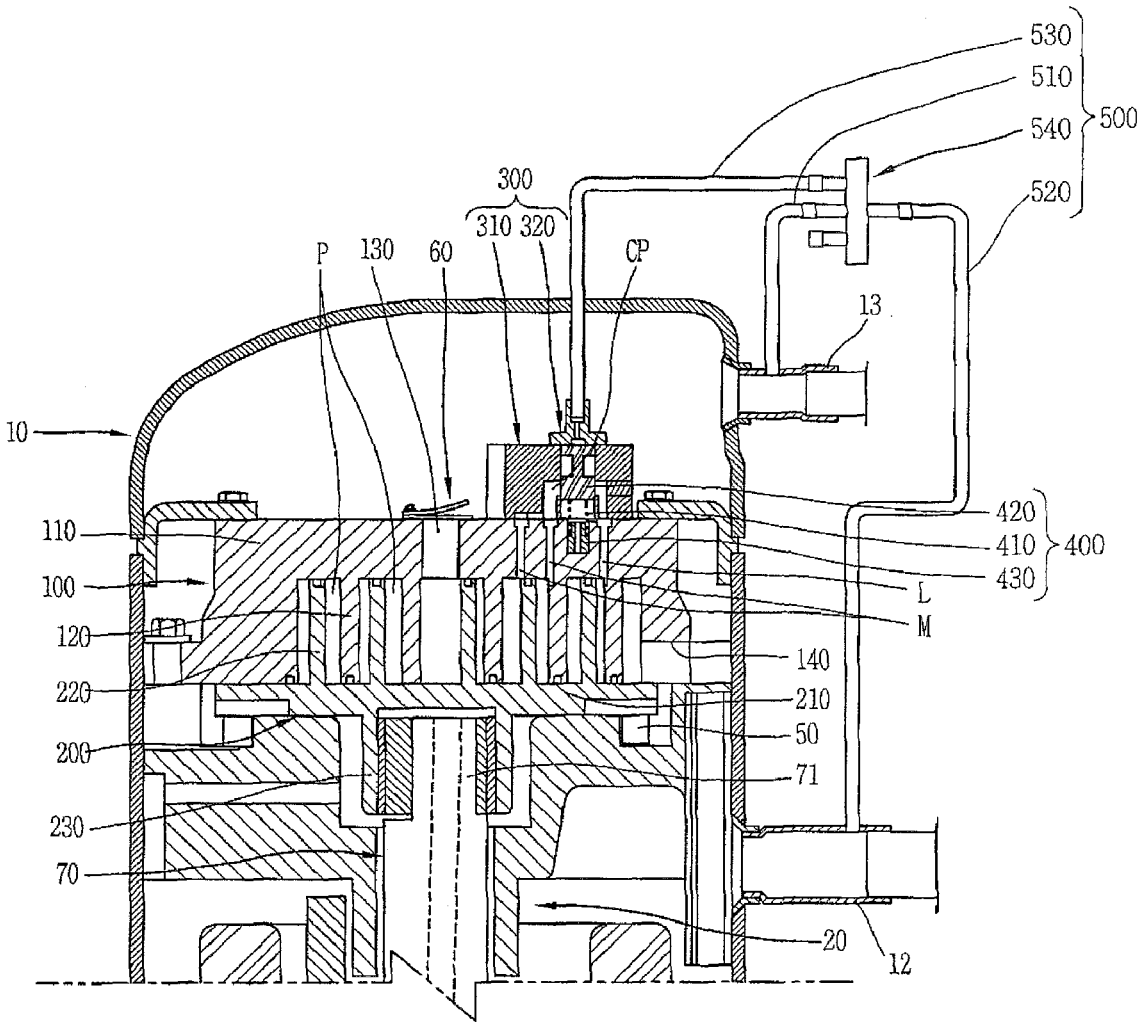
FIG. 3 is a cross-sectional view of a compression part of a scroll compressor having a mode changing apparatus for a scroll compressor according to an embodiment.
Figure 4:
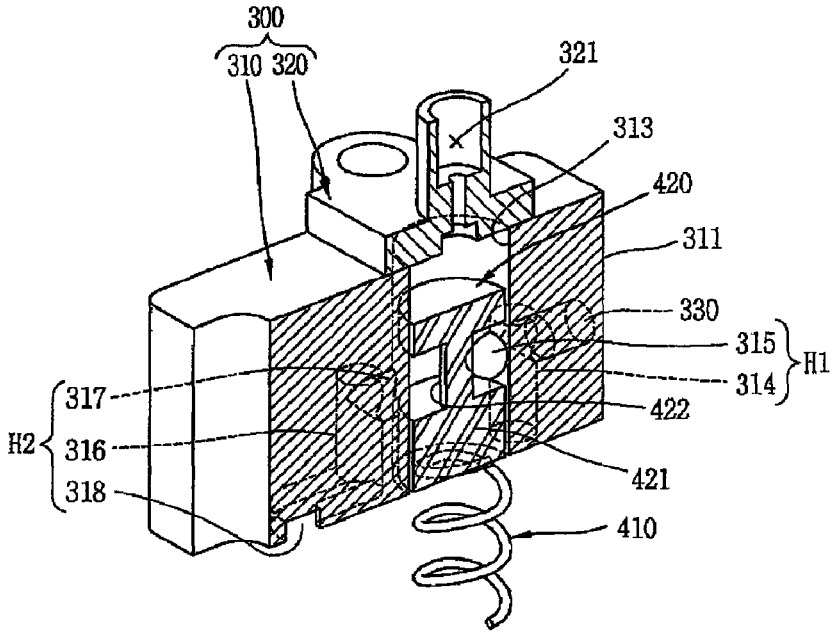
FIG. 4 is an exploded perspective view of a mode changing apparatus for a scroll compressor according to an embodiment.

FIG. 3 is a cross-sectional view of a compression part of a scroll compressor having a mode changing apparatus for a scroll compressor according to an embodiment. FIG. 4 is an exploded perspective view of a portion of the mode changing apparatus of FIG. 3.

As shown in FIGS. 3-4, the compression part of the scroll compressor, to which a mode changing apparatus according to an embodiment may be applied, may be configured such that a fixed scroll 100 is disposed adjacent an upper frame 20 mounted inside a casing 10 having a certain shape with a certain gap therebetween and is fixedly coupled to the inside of the casing 10, and an orbiting scroll 200 is disposed between the fixed scroll 100 and the upper frame 20 to perform an orbiting motion while being interlocked with the fixed scroll 100. The fixed scroll 100 may include an involute wrap 120 formed to have a certain thickness and height on one surface of a body portion 110 formed in a certain shape, a discharge hole 130 disposed at a center of the body portion 110, and an inlet 140 disposed at one side of the body portion 110. The orbiting scroll 200 may include an involute wrap 220 formed to have a certain thickness and height on one surface of a disk portion 210 having a certain thickness and area, and a boss portion 230 disposed on another surface of the disk portion 210.

The orbiting scroll 200 may be inserted between the upper frame 20 and the fixed scroll 100 such that the wrap 220 of the orbiting scroll 200 may be interlocked with the wrap 120 of the fixed scroll 100. As the orbiting scroll 200 performs an orbiting motion, a plurality of compression pockets P may be consecutively formed by the wrap 220 of the orbiting scroll 200 and the wrap 120 of the fixed scroll 100. In this embodiment, the compression pockets P positioned at an edge of the fixed scroll 100 form a suction pressure (a low pressure) area, the compression pockets P positioned at a central portion of the fixed scroll 100 form a discharge pressure (a high pressure) area, and the compression pockets P positioned between the edge and the central portion of the fixed scroll 100 form an intermediate pressure area. The orbiting scroll 200 may be supported on an upper surface of the upper frame 20.

An Oldham ring 50 may be inserted between the orbiting scroll 200 and the upper frame 20 to prevent the orbiting scroll 200 from rotating on its axis. A discharge valve assembly 60 may be provided on an upper surface of the fixed scroll 100 to open/close the discharge hole 130 in the fixed scroll 100. The boss portion 230 of the orbiting scroll may be connected to an eccentric portion 71 of a rotation shaft 70 inserted into the upper frame 20.

A suction pipe 12 through which a gas may be sucked may be penetratingly coupled to the casing 10, and a discharge pipe 13 through which a gas may be discharged may be coupled to the casing 10. The compression part may be a compression part of an asymmetric compressor.

A low-pressure passage L that communicates with a suction side formed by an orbiting motion of the orbiting scroll 200 may be provided. Further, an intermediate-pressure passage M that communicates with an intermediate pressure side formed by an orbiting motion of the orbiting scroll 200 may be provided.

Figure 5:
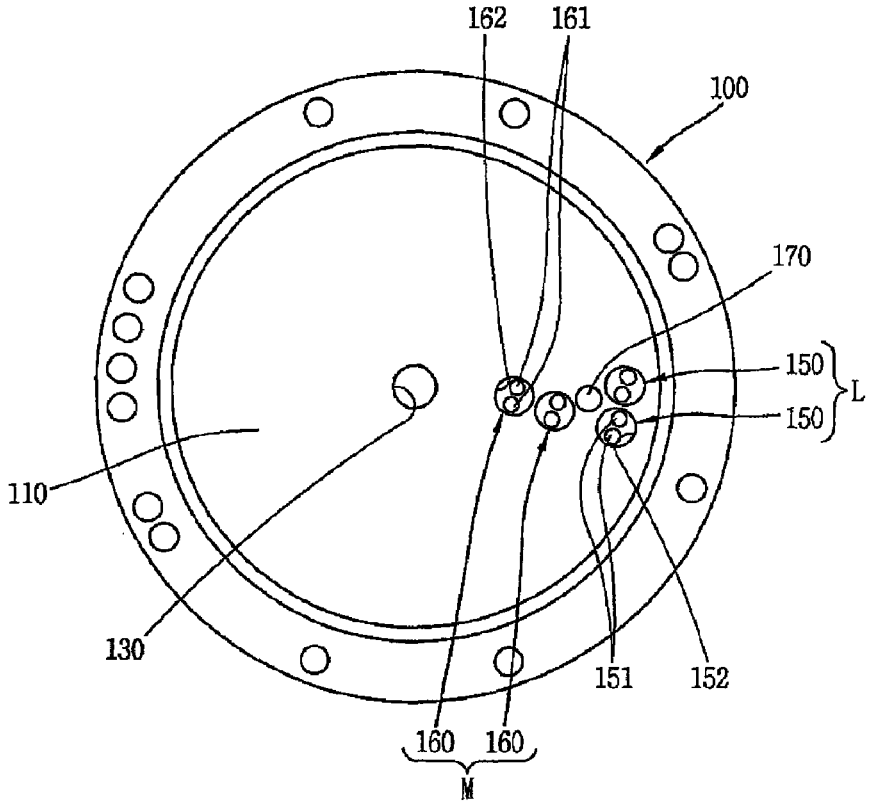
FIG. 5 is a plane view of a fixed scroll showing a low-pressure passage and an intermediate-pressure passage of the mode changing apparatus for a scroll compressor according to an embodiment.
Figure 6:
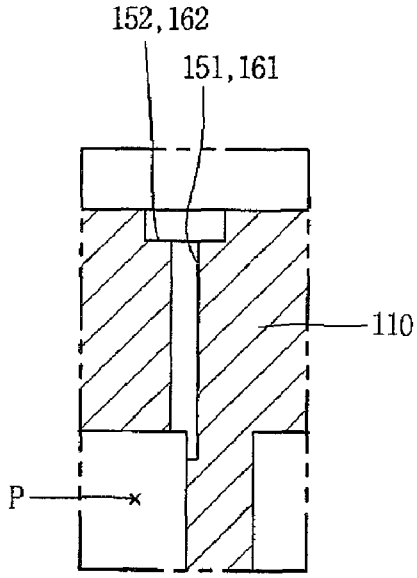
FIG. 6 is a cross-sectional view of a low-pressure passage or an intermediate-pressure passage of the mode changing apparatus for a scroll compressor according to an embodiment.

The low-pressure passage L and the intermediate-pressure passage M, as shown in FIGS. 5 and 6, may be respectively formed in the body portion 110 of the fixed scroll 100. The low-pressure passage L and the intermediate-pressure passage M may be formed to vertically penetrate the body portion 110 of the fixed scroll 100.

Further, the low-pressure passage L may be formed to have two passages 150 spaced apart from each other by a certain distance. Each passage 150 may include two through-holes 151, and the two through-holes 151 may be positioned inside a circular groove 152 having a certain inner diameter and depth.

Furthermore, the intermediate-pressure passage M may be formed to have two passages 160 spaced apart from each other by a certain distance. Each passage 160 may include two through-holes 161, and the two through-holes 161 may be positioned inside a circular groove 162 having a certain inner diameter and depth.

When compared to the intermediate-pressure passage M, the low-pressure passage L may be positioned a larger distant from the central portion of the body portion 110 of the fixed scroll (i.e., toward an edge of the body portion 110). The two passages 150 of the low-pressure passage L may be arranged in a circumferential direction, and the two passages 160 of the intermediate-pressure passage M may be arranged in a radial direction.

A block assembly 300 having a connection channel CP that connects the low-pressure passage L and the intermediate-pressure passage M may be coupled to an upper surface of the fixed scroll 100. The block assembly 300 may include a connection block 310 coupled to the upper surface of the fixed scroll 100 and having the connection channel CP therein, and a cover block 320 coupled to the connection block 310 and having a pressure channel 321 communicated with the connection channel CP.

Figure 7:
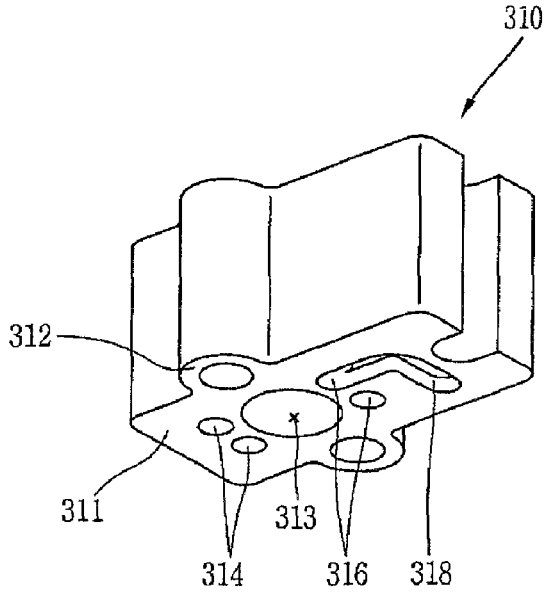
FIG. 7 is a perspective view of a connection block of the mode changing apparatus for a scroll compressor according to an embodiment.

The connection block 310, as shown in FIG. 7, may be configured to have a block body portion 311 having a certain thickness and area, coupling portions 312 each formed at both sides of the block body portion 311, and the connection channel CP provided in the block body portion 311. The connection channel CP may include a cylinder hole 313 penetratingly formed in the block body portion 311, a first passage H1 formed in the block body portion 311 to communicate the low-pressure passage L and the cylinder hole 313, and a second passage H2 formed in the block body portion 311 to communicate the intermediate-pressure passage M and the cylinder hole 313. The cylinder hole 313 may be formed to have a certain inner diameter and vertically penetrated in a thickness direction of the block body portion 311. Meanwhile, the cylinder hole 313 may be implemented in various shapes.

The first passage H1 may be formed to have a certain depth from a contact surface between the connection block 310 and the fixed scroll 100. An upper end of the first passage H1 may communicate with the cylinder hole 313 through lateral holes 315 later described. A lower end of the first passage H1 may include two vertical holes 314 that communicate with the through-holes 151 of the low-pressure passage L, and two lateral holes 315 that communicate with the two vertical holes 314 and the cylinder hole 313.

The second passage H2 may be formed to have a certain depth from a contact surface between the connection block 310 and the fixed scroll 100. An upper end of the second passage H2 may communicate with the cylinder hole 313 through lateral holes 317 later described. A lower end of the second passage H2 may include two vertical holes 316 that communicate with the through-holes 161 of the intermediate-pressure passage M, two lateral holes 317 formed to communicate with the cylinder hole 313 and the two vertical holes 316, and a connection groove 318 formed to have a curved shape and a certain depth from the contact surface between the connection block 310 and the fixed scroll 100, and configured to communicate one of the two vertical holes 317 with the through-hole 161. To facilitate processing, the lateral holes 317 of the second passage H2 may be formed on a straight line with respect to the respective lateral holes 315 of the first passage H1.

The connection channel CP may be formed as follows. The four vertical holes 314, 316 may be respectively formed on the contact surface of the block body portion 311 of the connection block 310. Then, holes for respectively connecting the two vertical holes 314, 316 may be formed at a side surface of the block body portion 311. The cylinder hole 313 formed to penetrate the block body portion 311 may be formed at a center of the four holes. A cover 330 may be coupled to each of the two holes on the side surface of the block body portion 311.

The connection block 310 may be fixedly coupled onto the upper surface of the fixed scroll 100 such that the first passage H1 may communicate with the low-pressure passage L and the second passage H2 may communicate with the intermediate-pressure passage M. The connection block 310 may be coupled to the fixed scroll 100 by a plurality of coupling bolts (not shown). The two vertical holes 314 of the first passage H1 may respectively communicate -with the two passages 150 of the low-pressures passage L, and the connection groove 318 of the second passage H2 and one vertical hole 316 may respectively communicate with the two passages 160 of the intermediate-pressure passage M.

The pressure channel 321 of the cover block 320 may be implemented as a through hole vertically penetrating a center of the cover block 320. A size of the through hole may be formed to be smaller than that of the cylinder hole 313.

The cover block 320 may be coupled onto the upper surface of the connection block 310 such that the pressure channel 321 may communicate with the cylinder hole 313, and one surface of the cover block 320 may serve to block the cylinder hole 313 of the connection block 310. Further, the block assembly 300 may be provided with a switching device 400 that opens/closes the connection channel CP of the block assembly 300.

The switching device 400 may include a spring 410 disposed in the connection channel CP, and a piston 420 movably inserted into the connection channel CP so as to open/close the connection channel CP. The spring 410 may be a circular coil spring. The spring 410 may be inserted into the cylinder hole 313 of the connection block 310. On the upper surface of the fixed scroll 100 facing the cylinder hole 313, a spring insertion hole 170 may be formed to have a certain depth and inner diameter so as to insert one side of the spring 410 therein. A discharge hole 171 that discharges a pressure generated when the piston 420 moves may be formed between the spring insertion hole 170 and the low-pressure passage L. The discharge hole 171 may be formed on the upper surface of the fixed scroll 100 to communicate with the low-pressure passage L.

A spring support block 430 having a certain outer diameter and length and having a through hole formed at a center thereof may be inserted into the spring insertion hole 170, to thereby support one side of the spring 410. A length of the spring support block 430 may be smaller than a depth of the spring insertion hole 170.

The piston 420 may include a piston body 421 having a certain length and area, and a connection passage 422 formed at a central portion of the piston body 421. A shape of a cross-section of the piston body 421 may be formed to correspond to a shape of that of the cylinder hole 313. The shape of the cross-section thereof may be a circular shape. The connection passage 422 may be formed in a groove shape having a certain width and depth on an outer surface of the piston body 421. If the piston 420 is inserted into the cylinder hole 313, one side of the piston 420 may contact another side of the spring 410 and thereby be supported by an elastic force of the spring 410, and another side of the piston 420 may be supported by contacting the lower surface of the cover block 320. In addition, a surface of the piston 420 which contacts the cover block 320 may cover (block) the pressure channel 321 of the cover block 320. The piston body 421 of the piston 420 may be divided into two sides by the connection passage 422, and one side thereof may cover (block) the first and second passages H1 and H2.

If a pressure greater than the elastic force of the spring 410 is applied to the pressure channel 321 of the cover block 320, the piston 420 may move downwardly while pushing the spring 410, and the connection passage of the piston 420 may be positioned between the first passage H1 and the second passage H2, so that the first passage H1 and the second passage H2 communicate.

A pressure supply device 500 selectively applies, to the block assembly 300, a discharge gas pressure discharged from the fixed and orbiting scrolls 100, 200 and a suction gas pressure sucked into the fixed and orbiting scrolls 100, 200, to thereby operate the switching device 400. The pressure supply device 500 may include a first connection pipe 510 connected to the discharge pipe 13, a second connection pipe 520 connected to the suction pipe 12, a third connection pipe 530 connected to the connection channel CP of the block assembly 300, and a valve 540 respectively connected to the first, second, and third connection pipes 510, 520, 530 that selectively provides communication between the first and the third connection pipes 510, 530 or the second and third connection pipes 520, 530.

The valve 540 may be implemented as a 3-way valve; however, a 4-way valve may also be used by closing one channel thereof. The valve 540 may be positioned outside of the casing 10.

The third connection pipe 530 may be coupled to the cover block 320 so as to communicate with the pressure channel 321 of the cover block 320 by penetrating the casing 10. A connecting portion of the third connection pipe 530 and the casing 10 may be coupled, for example, by welding.

Hereinafter, description of the operation of a mode changing apparatus for a scroll compressor according to embodiments will be given.

First, the operation of the compression part of the scroll compressor will be described. If rotation force of the motor part is transferred to the orbiting scroll 200 through the rotation shaft 70, the orbiting scroll 200 may perform an orbiting motion based on the center of the rotation shaft 70 while being interlocked with the fixed scroll 100. As the orbiting scroll 200 performs an orbiting motion, the wrap 220 of the orbiting scroll 200 may perform an orbiting motion while being interlocked with the wrap 120 of the fixed scroll 100. A plurality of compression pockets P may be formed between the wrap 220 of the orbiting scroll 200 and the wrap 120 of the fixed scroll 100. As the compression pockets P move toward the center of the fixed scroll 100, the compression pockets P may change (i.e., decrease) in volume. Accordingly, a gas may be sucked, compressed, and discharged through the discharge hole 130 in the fixed scroll 100. As the orbiting scroll 200 performs the orbiting motion, the plurality of the compression pockets P may be continuously formed at the edge of the fixed scroll 100 and the orbiting scroll 200, and thereby move toward the center of the fixing scroll 100, thus compressing a gas. The gas sucked through the suction pipe 12 may be introduced into the compression pockets P through the inlet 140 of the fixed scroll 100.

A state when the compression pockets P are positioned at the edge of the fixed scroll 100, is called a suction pressure state (the low pressure), and a state when the compression pockets P are positioned at the center of the fixed scroll 100 is called a discharge pressure state (the high pressure). A state when the compression pockets P are positioned between the center of the fixed scroll 100 and the edge thereof is called an intermediate-pressure state.

The high-temperature/high-pressure gas discharged from the discharge hole 130 of the fixed scroll 100 may be discharged to the outside of the scroll compressor through the discharge pipe 13.

Figure 8:
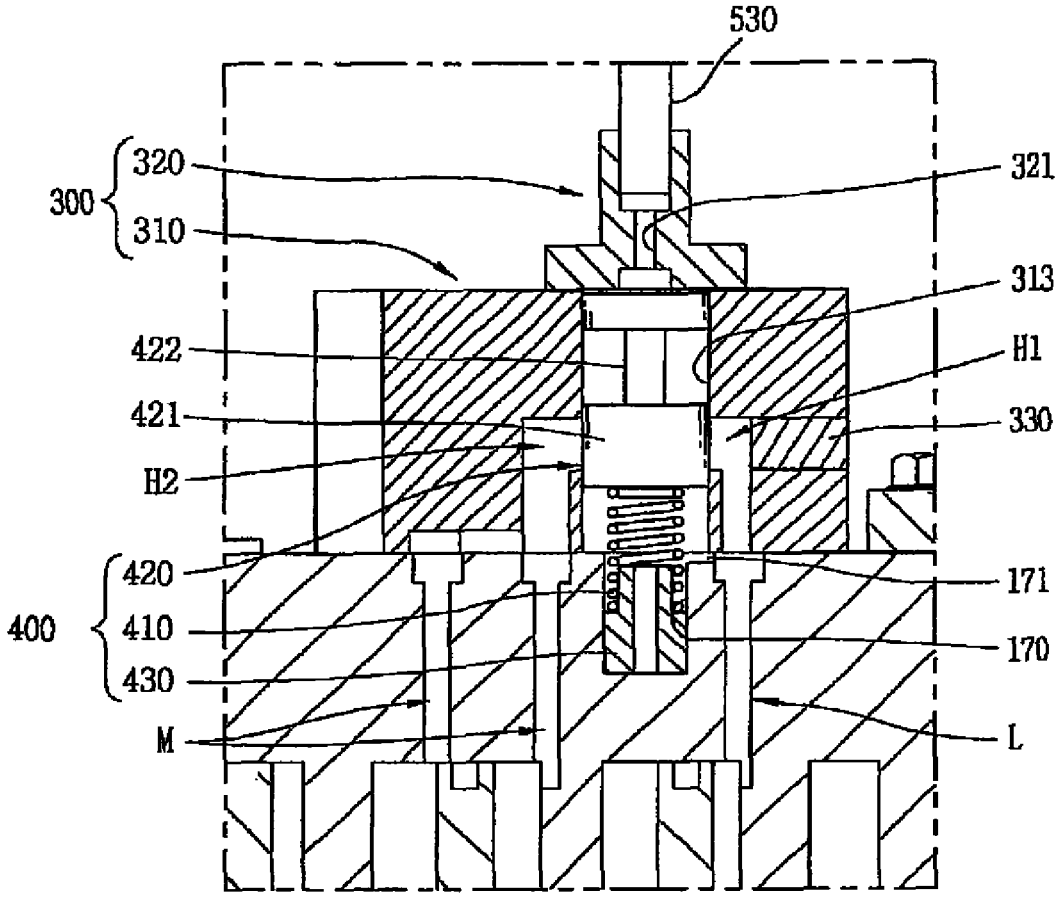
FIGS. 8 and 9 are cross-sectional views showing operating states of the mode changing apparatus for a scroll compressor according to an embodiment.

Meanwhile, when the scroll compressor is operated at a capacity of 100% under a large load (hereinafter, referred to as a 'power mode'), as shown in FIG. 8, the valve 540 of the pressure supply device 500 provides communication between the second connection pipe 520 and the third connection pipe 530. Then, a low pressure of the suction pipe 12 may be applied to the pressure channel 321 of the cover block 320 through the second and third connection pipes 520 and 530, and then to the piston 420.

Since the low pressure of the suction pipe 12 may be applied to the piston 420, the elastic force of the spring 410 supporting one side of the piston 420 may become greater than the low pressure applied to another side of the piston 420, thereby not moving the piston 420 and blocking the first passage H1 and the second passage H2. In the state that the first passage H1 and the second passage H2 are blocked by the piston 420, the compression pocket P positioned at the suction side and the compression pocket P positioned at the intermediate-pressure side are not connected to each other. Accordingly, as described above, while the compression pockets P positioned at the edge of the fixed scroll 100 move toward the center of the fixed scroll 100, the gas having sucked into the compression pockets P at the edge is compressed and discharged.

Figure 9:
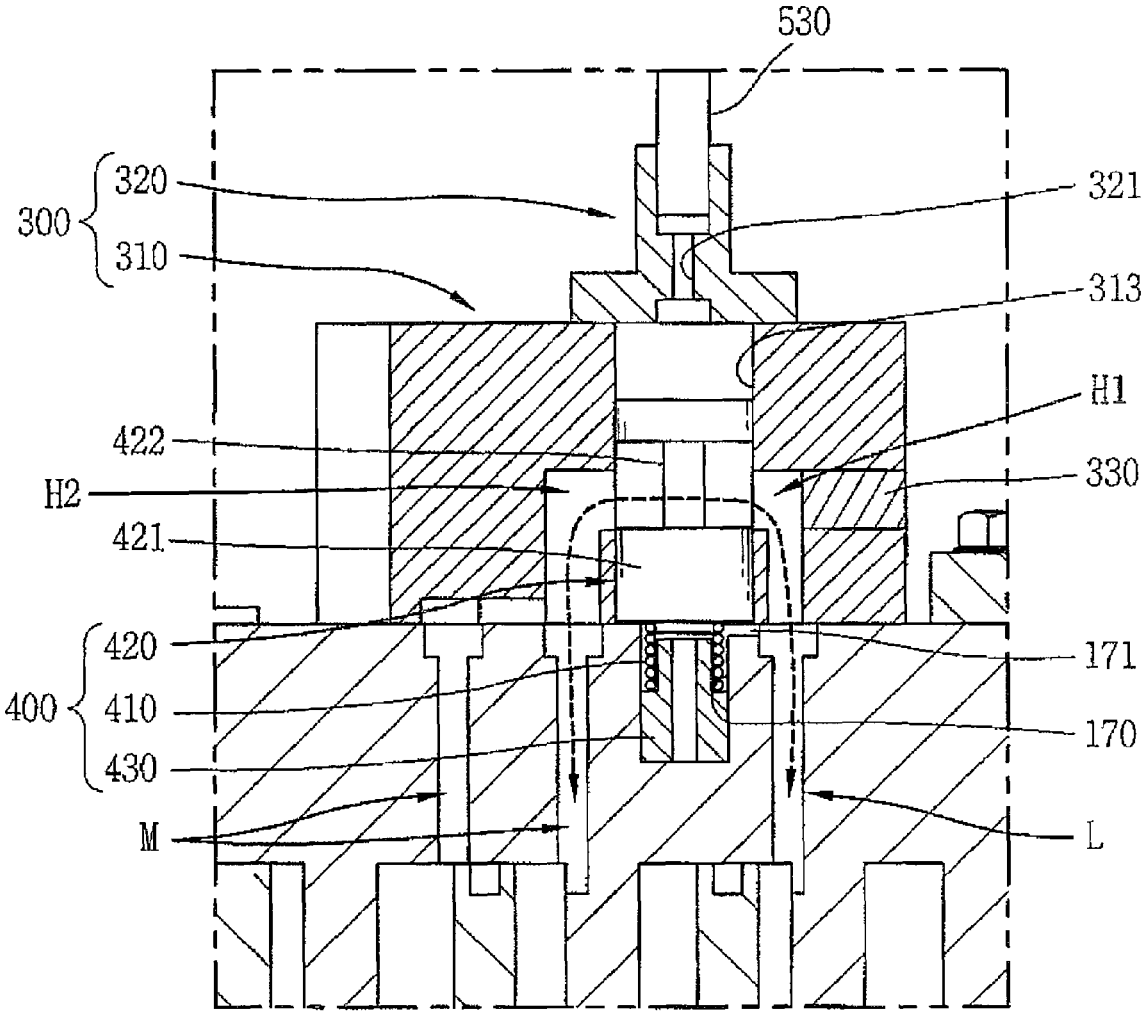

When the scroll compressor is operated to reduce its compression capacity under a small load (hereinafter, referred to as a 'saving mode'), as shown in FIG. 9, the valve 540 of the pressure supply device 500 may be operated to provide communication between the first connection pipe 510 and the third connection pipe 530. Once the first connection pipe 510 and the third connection pipe 530 communicate, the high pressure of the discharge pipe 13 is applied to the pressure channel 321 of the cover block 320 through the first and third connection pipes 510 and 530, and then to the piston 420.

If the high pressure applied to one side of the piston 420 becomes greater than the elastic force of the spring 410 supporting another side of the piston 420, the piston 420 moves downwardly while the spring 410 is compressed. Then, the first and second passages H1 and H2 communicate with each other by means of communication passage 421 of the piston 420. Accordingly, the compression pockets P under the intermediate-pressure state and the compression pockets P under the suction pressure state communicate with each other.

If the scroll compressor is operated in the above state, the compression pockets P under the intermediate-pressure state and the compression pockets P under the suction pressure state communicate with each other. Thusly, the compression pockets P under the intermediate-pressure state become the suction pressure state (the low pressure). Accordingly, as the compression pockets P move from the intermediate-pressure position to the discharge hole 130 of the fixed scroll 100, the compression pockets P decrease in volume, thereby compressing a gas. The compressed gas is discharged from the discharge hole 130 of the fixed scroll 100. Accordingly, the pressure and amount of the gas discharged through the discharge hole 130 is reduced.

Figure 10:
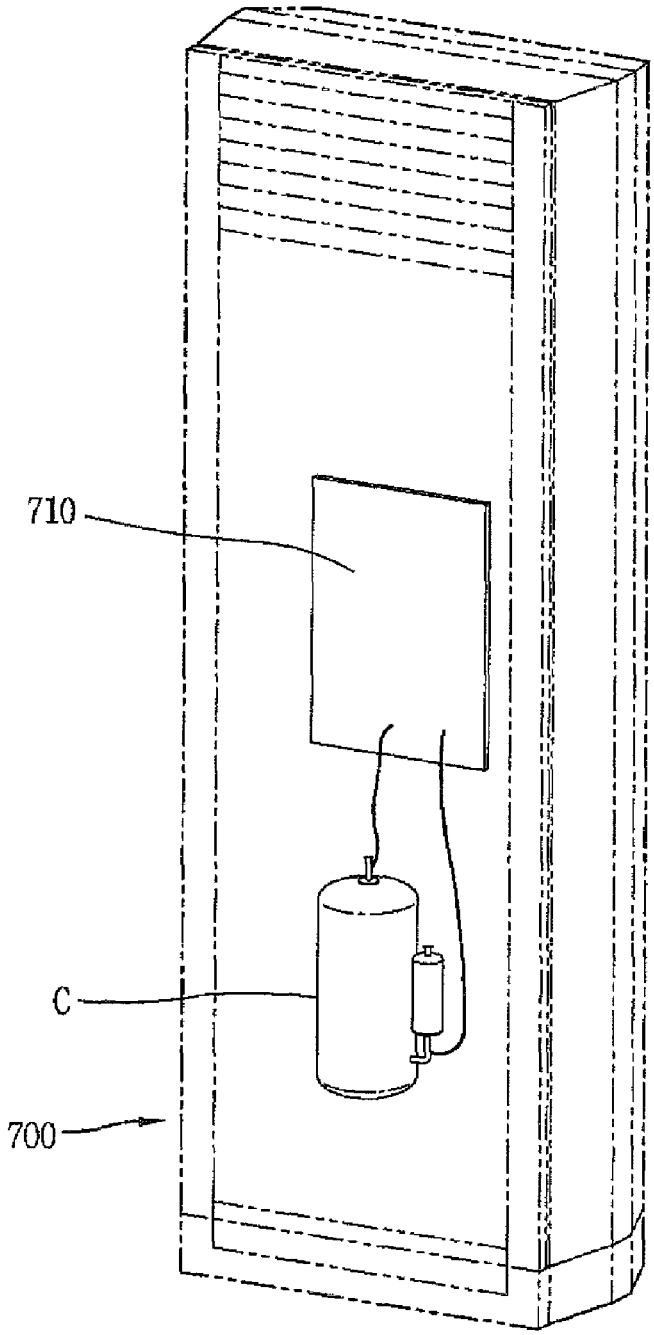
FIG. 10 is a schematic view of an exemplary air conditioner including the scroll compressor of FIG. 3.
Figure 11:
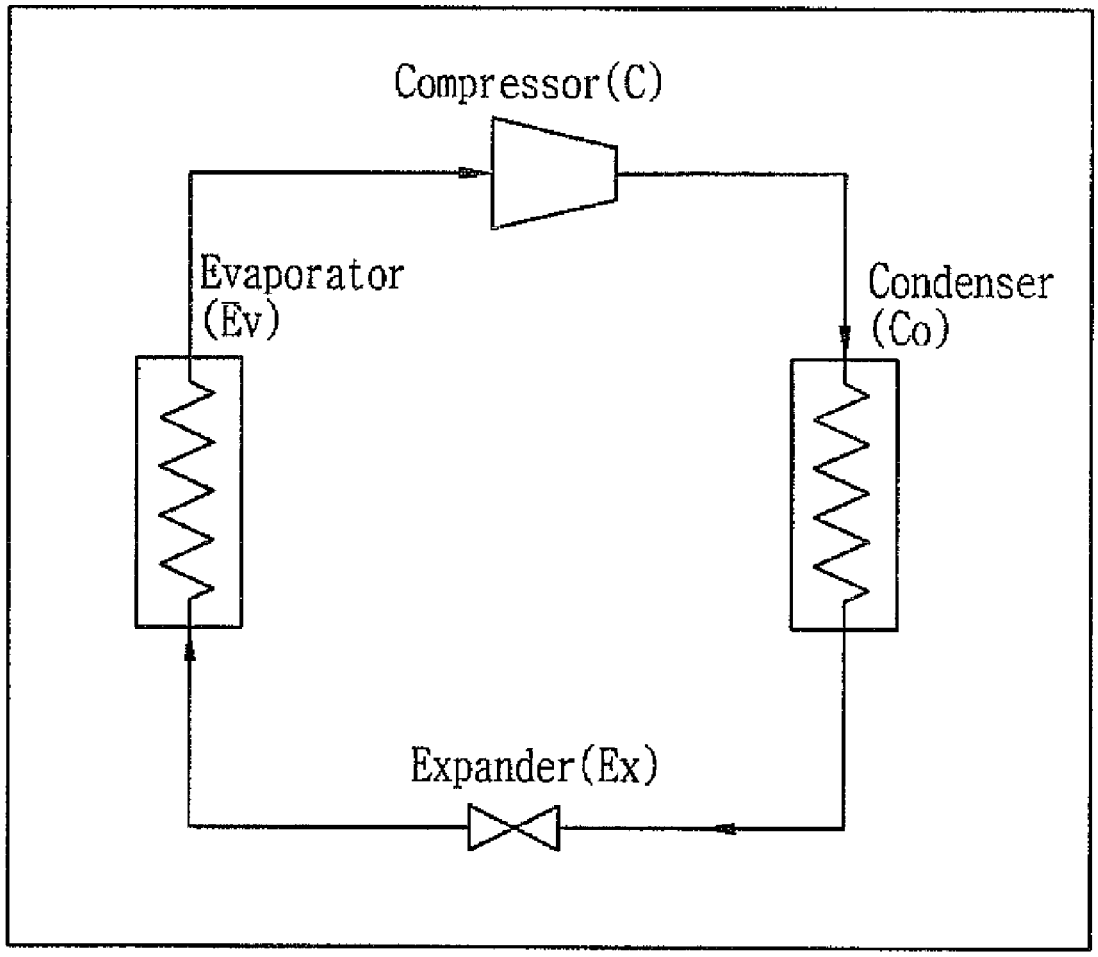
FIG. 11 is a schematic drawing of a refrigerating cycle of the air conditioner of FIG. 10.

As so far described, embodiments disclosed herein enable the pressure supply device 500 to selectively apply the discharge pressure and the suction pressure to the piston 420 of the switching device 400 and thereby operate (move) the piston 420, thus providing communication between the intermediate-pressure side and the suction-pressure side formed by the fixed scroll 100 and the orbiting scroll 200 or to blocking the communication. Therefore, the scroll compressor can be operated in the power mode operating at a capacity of 100% or in the saving mode operating with the reduced compression capacity. Accordingly, if the scroll compressor according to embodiments is mounted in an air conditioner, such as air conditioner 700 shown in FIG. 10 having a refrigerating cycle as shown in FIG. 11, it may be operated in the power mode during the summer and in the saving mode during the fall and spring. In such an embodiment, the compressor C may be connected to a main board 710 that controls overall operation of the air conditioner 700. When compared to the conventional operation mode using an on/off scheme, energy efficiency of approximately 25%~33% over the entire system may be expected.

In addition, for the inverter scheme using an adjustable speed motor, the motor is rotated at a low speed in the saving mode operation. Small amounts of oil contained in a lower surface of the casing 10 would be supplied to the compression part, thereby causing a problem of oil supply and reliability. However, the motor of the motor part in embodiments disclosed herein is rotated at a constant-speed, thereby maintaining the oil supply and reliability.

Embodiments disclosed herein enable the power mode operation and the saving mode operation using the block assembly 300, the switching device 400 and the pressure supply device 500, thereby simplifying construction. In addition, when a problem occurs, the pressure supply device 500 may be positioned outside of the casing 10, thereby making it easy to repair.

Embodiments disclosed herein provide a mode changing apparatus for a scroll compressor which can vary gas compression capacity as well as simplify a structure for varying the capacity. In addition, embodiments disclosed herein provide a mode changing apparatus for a scroll compressor which can facilitate a repair when a problem occurs.

In accordance with embodiments disclosed herein, there is provided a mode changing apparatus for a scroll compressor that includes a fixed scroll and an orbiting scroll which are disposed inside a casing and form consecutively moving compression pockets by a reciprocal motion thereof; a low-pressure passage which is communicated with a suction side of the compression pockets; an intermediate-pressure passage which is communicated with the compression pockets; a block assembly which has a connection channel for connecting the low-pressure passage and the intermediate-pressure passage; a switching unit or device disposed at the block assembly that opens/closes the connection channel; and a pressure supply unit or device that selectively applies, to the switching unit, a discharge gas pressure discharged from the fixed and orbiting scrolls and a suction gas pressure sucked into the fixed and orbiting scrolls and thereby to operate the switching unit.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A mode changing apparatus for a scroll compressor, the mode changing apparatus comprising:

at least one low pressure passage configured to communicate with a low pressure area of the scroll compressor;

at least one intermediate pressure passage configured to communicate with an intermediate pressure area of a plurality of compression pockets of the scroll compressor; and a mode changing assembly configured to selectively allow communication between the at least one low pressure passage and the at least one intermediate pressure passage based on a selected mode, wherein the mode changing assembly comprises:

a communication member;

a block assembly having a chamber configured to receive the communication member therein and a passage that allows communication between the at least one low pressure passage and the at least one intermediate pressure passage; and a pressure control device that supplies a high or low pressure to the chamber, wherein the communication member comprises a piston, and wherein the piston has a passage formed in a groove shape on an outer surface thereof, which extends therethrough and is configured to allow communication between the at least one low pressure passage and the at least one intermediate pressure passage when aligned with the passage of the block assembly.

2. The mode changing apparatus of claim 1, further comprising a spring positioned between a lower surface of the piston and an inner surface of the chamber.

3. The mode changing apparatus of claim 1, wherein the at least one low pressure passage and the at least one intermediate pressure passage are each formed in a body portion of a fixed scroll of the scroll compressor.

4. The mode changing apparatus of claim 1, wherein the pressure control device comprises:

a first connection pipe providing communication between a pressure supply device and the chamber;

a second connection pipe providing communication between a discharge pipe of the scroll compressor and the pressure supply device; and a third connection pipe providing communication between a suction pipe and the pressure supply device.

5. A scroll compressor comprising the mode changing apparatus of claim 1.

6. The mode changing apparatus of claim 3, wherein the at least one low pressure passage and the at least one intermediate pressure passage each comprise two passages spaced apart from each other by a predetermined distance.

7. The mode changing apparatus of claim 3, wherein the at least one low pressure passage and the at least one intermediate pressure passage each comprise a groove formed in an upper surface of the body portion of the fixed scroll and a plurality of through-holes in communication with the groove and the low pressure area or intermediate pressure area, respectively.

8. The mode changing apparatus of claim 7, wherein a diameter of each through-hole is less than a width of a wrap of an orbiting scroll of the scroll compressor.

9. The mode changing apparatus of claim 7, wherein a lower opening of each through-hole is angled to enlarge a pressure contact portion.

10. A mode changing apparatus for a scroll compressor, the mode changing apparatus comprising:

a fixed scroll and an orbiting scroll, which arc disposed inside a casing and form a plurality of consecutively moving compression pockets by a reciprocal motion thereof;

at least one low pressure passage configured to communicate with a low pressure area of the plurality of compression pockets of the scroll compressor;

at least one intermediate pressure passage configured to communicate with an intermediate pressure area of the plurality of compression pockets of the scroll compressor; and a communication member;

a block assembly having a chamber configured to receive the communication member therein; and a pressure control device in communication with the chamber, wherein when a low pressure is supplied by the pressure control device to the chamber, the communication member blocks communication between the at least one low pressure passage and the at least one intermediate pressure passage, and when a high pressure is supplied to the chamber by the pressure control device, the communication member allows communication between the at least one low pressure passage and the at least one intermediate pressure passage, wherein the communication member has a passage formed in a groove shape on an outer surface thereof, which extends therethrough and is configured to allow communication between the at least one low pressure passage and the at least one intermediate pressure passage when aligned with a passage formed in the block assembly, and wherein the pressure control device comprises:

a first connection pipe that provides communication between a pressure supply device and the chamber;

a second connection pipe that provides communication between a discharge pipe of the scroll compressor and the pressure supply device; and a third connection pipe that provides communication between a suction pipe of the scroll compressor and the pressure supply device.

11. The mode changing apparatus of claim 10, wherein the communication member comprises a piston.

12. The mode changing apparatus of claim 10, wherein the at least one low pressure passage and the at least one intermediate pressure passage are each formed in a body portion of the fixed scroll.

13. A scroll compressor comprising the mode changing apparatus of claim 10.

14. The mode changing apparatus of claim 10, wherein the pressure supply device is disposed outside of the casing.

15. The mode changing apparatus of claim 11, further comprising a spring positioned between a lower surface of the piston and an inner surface of the chamber.

16. The mode changing apparatus of claim 12, wherein the at least one low pressure passage and the at least one intermediate pressure passage each comprise two passages spaced apart from each other by a predetermined distance.

17. The mode changing apparatus of claim 12, wherein the at least one low pressure passage and the at least one intermediate pressure passage each comprise a groove formed in an upper surface of the body portion of the fixed scroll and a plurality of through-holes in communication with the groove and the low pressure area or intermediate pressure area, respectively.

18. The mode changing apparatus of claim 17, wherein a diameter of each through-hole is less than a width of a wrap of the orbiting scroll.

19. The mode changing apparatus of claim 17, wherein a lower opening of each through-hole is angled to enlarge a pressure contact portion.

20. The mode changing apparatus of claim 14, wherein the pressure supply device comprises a valve.

* * * * *